US007549629B2

(12) United States Patent
Tateishi et al.

(10) Patent No.: US 7,549,629 B2
(45) Date of Patent: Jun. 23, 2009

(54) IMAGE FORMING APPARATUS

(75) Inventors: Satohisa Tateishi, Abiko (JP); Junichi Moteki, Abiko (JP); Youichi Chikugo, Toride (JP); Seiichiro Kameda, Abiko (JP); Kozo Inoue, Toride (JP); Takashi Fujita, Kashiwa (JP); Hiroaki Takagishi, Tokyo (JP); Nobuto Kamiyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 11/746,929

(22) Filed: May 10, 2007

(65) Prior Publication Data

US 2007/0267803 A1 Nov. 22, 2007

(30) Foreign Application Priority Data

May 19, 2006 (JP) ..... 2006-140887

(51) Int. Cl.
*B65H 3/14* (2006.01)
*B65H 3/08* (2006.01)

(52) U.S. Cl. ..... 271/98; 271/103; 399/97

(58) Field of Classification Search ..... 271/93, 271/97, 98, 103, 90; 399/97, 44
See application file for complete search history.

(56) References Cited

U.S. PATENT DOCUMENTS

| | | | | |
|---|---|---|---|---|
| 6,042,099 | A | 3/2000 | Takagishi | 271/2 |
| 6,398,214 | B1 | 6/2002 | Moteki et al. | 271/220 |
| 6,409,043 | B1 | 6/2002 | Fujita et al. | 221/10.03 |
| 6,473,579 | B1 | 10/2002 | Suzuki et al. | 399/124 |
| 6,647,243 | B2 | 11/2003 | Sato et al. | 399/407 |
| 6,771,928 | B2 | 8/2004 | Fujijta | 399/394 |
| 6,845,228 | B2 | 1/2005 | Suzuki et al. | 399/407 |
| 7,034,925 | B2 | 4/2006 | Kamiyama et al. | 355/407 |
| 7,107,006 | B1 | 9/2006 | Sato et al. | 399/407 |
| 7,108,256 | B2 | 9/2006 | Moteki | 270/58.09 |
| 7,120,383 | B2 | 10/2006 | Sato et al. | 399/407 |
| 7,237,771 | B2 * | 7/2007 | Lang et al. | 271/9.01 |
| 7,445,205 | B2 * | 11/2008 | Soures et al. | 271/97 |
| 2004/0258442 | A1 * | 12/2004 | Uchida et al. | 399/396 |
| 2005/0067757 | A1 * | 3/2005 | Suga et al. | 271/98 |
| 2006/0170145 | A1 * | 8/2006 | Nakane | 271/97 |
| 2007/0158897 | A1 * | 7/2007 | Soures et al. | 271/97 |
| 2008/0247774 | A1 * | 10/2008 | Koga | 399/97 |

FOREIGN PATENT DOCUMENTS

| | | | |
|---|---|---|---|
| JP | 61023068 | * | 1/1986 |
| JP | 06001467 | * | 1/1994 |
| JP | 2001-48366 | | 2/2001 |
| JP | 2002-333275 | | 11/2002 |

* cited by examiner

*Primary Examiner*—Patrick H Mackey
*Assistant Examiner*—Patrick Cicchino
(74) *Attorney, Agent, or Firm*—Fitzpatrick, Cella, Harper & Scinto

(57) ABSTRACT

An air heating mechanism for heating the air which is blown from a loosening/separating nozzle toward the top sheet attracted to an attracting and conveying unit is provided. A control unit controls the air heating mechanism based on moisture content information from a sensor for detecting a moisture content of a sheet supported by the tray.

5 Claims, 6 Drawing Sheets

IMAGE FORMING APPARATUS

BACKGROUND OF THE INVENTION

1. Field of the Invention

The present invention relates to an image forming apparatus and, more particularly, to an image forming apparatus having a sheet feeding apparatus for separating and feeding sheets by blowing an air to the sheets.

2. Description of the Related Art

Hitherto, an image forming apparatuses such as printer, copying apparatus, or the like has a sheet feeding apparatus for feeding sheets one by one to an image forming unit. In such a sheet feeding apparatus, in order to certainly separate and feed the sheets one by one, various sheet separating systems have been used hitherto.

As such a sheet separating system, for example, there is a retard separating system in which a retard roller (separating roller) driven in the direction opposite to the sheet conveying direction is come into pressure contact with a feed roller at a predetermined torque, thereby preventing double feeding. There is also a separating pad system in which a frictional member is come into pressure contact with the feed roller, thereby preventing double feeding.

In the case of separating and feeding the sheets by such a sheet separating system, for example, in the case of the retard separating system, by optimizing one of a return torque and a pressure-contact force of a retard roller in consideration of a frictional force of the sheet to be fed, the sheets can be certainly separated one by one.

In recent years, in association with the diversification of a variety of sheets (record media), there has been increasing a demand for forming images onto sheets such as super thick paper, OHP sheet, art film, and also coating paper obtained by executing a coating process to the surface of a sheet in order to obtain a whiteness index and a gloss in order to meet a market requirement to form a color image, and the like.

However, in the conventional sheet feeding apparatus, in the case of continuously feeding such sheets, for example, in the case of feeding the super thick paper, its own weight becomes a conveyance resistance, so that the sheets cannot be picked up but a jam occurs.

In the case of a sheet such as OHP sheet or art film made of a resin material which is liable to be charged, particularly, upon feeding in a low humidity environment, the sheets rub mutually, so that the sheet surfaces are gradually charged. Since the sheets themselves are adhered by such charging of the sheet surfaces, the sheets cannot be picked up and the double feeding occurs.

In the case of the sheet such as coating paper whose surface has been coated with a paint or the like, particularly, in the case where the sheets have been stacked in a high humidity environment, such sheets have a nature in which the sheets themselves are attracted. Therefore, in the conventional sheet separating system, the sheets cannot be picked up and the double feeding occurs.

This is because in the case of such special sheets, although a frictional force itself of the sheets is equal or smaller than that of plain paper mentioned above, an attracting force obtained by the frictional charging in the low humidity environment and an attracting force between the sheets of coating paper in the high humidity environment are remarkably larger than a frictional force between the sheets of plain paper. On the other hand, according to the conventional sheet separating system, since only the frictional force between the sheets is considered, the sheets attracted by such a strong force cannot be fully separated.

Therefore, among the conventional sheet feeding apparatuses, in order to release the adsorption of the sheets attracted by the very strong attracting force, there is an apparatus in which the sheets are fed by an air sheet feeding system using a sheet separating system in which the air is blown to side portions of the sheets, and the adsorption between the sheets is eliminated by the air.

In the case of the sheet feeding apparatus for feeding the sheets by the air sheet feeding system, when the sheets are fed, the air is blown from the side portion of a sheet bundle by a pre-separating air loosening unit, thereby preliminarily loosening the sheets and eliminating the adsorption between the sheets.

Subsequently, the sheets which have previously been loosened are attracted to an attracting and conveying belt in order from the top sheet. And the separating air is blown to the sheets from a separating air unit provided on a downstream side of the belt, thereby separating the sheets one by one. The sheet feeding apparatus using such an air sheet feeding system is used in a print business world and partial copying apparatuses because even the sheets having the large attracting force can be separated and fed.

In such an air sheet feeding system, particularly, in order to reduce the attracting force of the sheets such as coating paper or the like in the high humidity environment, a method of dehumidifying the sheets by heating the blowout air by a heater has been proposed. Such a technique has been disclosed in Japanese Patent Application Laid-Open No. 2001-048366.

FIG. 6 is a diagram illustrating such a construction of the conventional sheet feeding apparatus in which the sheets are dehumidified by a heated blowout air. In FIG. 6, a sheet feeding apparatus 100 has an attracting and conveying belt 101. The attracting and conveying belt 101 can circle in the sheet feeding direction. The belt 101 attracts a top sheet St among sheets S stacked on a tray (not shown) and conveys the sheet St to the downstream.

A sucking duct 103 for activating a negative pressure is provided inside of the attracting and conveying belt 101. The negative pressure is activated in order to suck the top sheet St by a sucking air which is caused by a sucking fan 102. A pre-separating nozzle 110 for floating and loosening the sheets S is provided under the downstream side in the rotating direction of the attracting and conveying belt 101. The pre-separating nozzle 110 blows a loosening air to the sheets S stacked on the tray from their front edge side surfaces, thereby allowing the sheets S to be floated and loosened. In order to prevent the double feeding, a separating nozzle 109 for blowing a separating air so as to peel off a next sheet Sn from the top sheet St attracted onto the attracting and conveying belt 101 is also provided.

In FIG. 6, a fan 106 sucks the air into the duct 107. The air sucked by the fan 106 is guided from the duct 107 to a separating air duct 104 and a pre-separating air duct 105. An air heater 108 is provided in the duct in order to heat the air sucked by the fan 106.

In FIG. 6, an air As is blown out from the separating nozzle 109 and an air Ap is blown out from the pre-separating nozzle 110. The attracting and conveying belt 101 is suspended between a driving roller 101*a* and a driven roller 101*b*, so that the attracting and conveying belt 101 is circled by those rollers.

In the sheet feeding apparatus 100 mentioned above, after the air sucked into the duct 107 by the fan 106 passed through the heater 108, the air is separated into the separating air duct 104 and the pre-separating air duct 105. Thereafter, the air is blown to the outside as one of the separating air As from the separating nozzle 109 and the pre-separating air Ap from the pre-separating nozzle 110.

The pre-separating nozzle 110 faces the edge portions of the sheets S. By blowing the pre-separating air Ap to the sheet edge portions, the stacked sheets S can be loosened by the air and the adsorption between the sheets can be eliminated. The separating air As is blown toward the attracting and conveying belt 101 from the separating nozzle 109.

Subsequently, when driving the sucking fan 102, the top sheet St stacked in the top position of the sheets S in the state where they have been loosened is sucked to the attracting and conveying belt 101 by the sucking force of the sucking fan 102. Thereafter, by driving the driving roller 101*a*, the attracting and conveying belt 101 is circled in the state where the top sheet St has been attracted to the belt, so that the top sheet St is conveyed. When the top sheet St is conveyed in this manner, the next sheet Sn just under the top sheet St is separated by the separating air As from the separating nozzle 109.

The air heater 108 is controlled based on external temperature and humidity detected by an environment sensor (not shown). Specifically speaking, the air heater 108 is turned on in the high temperature and high humidity environment and is turned off in the low temperature and low humidity environment.

By turning on the air heater 108 in the high temperature and high humidity environment as mentioned above, the pre-separating air Ap and the separating air As can be heated, so that the sheets S can be dehumidified. Thus, the attracting force between the sheets due to the moisture adsorption can be reduced and the sheets can be certainly separated. There is also an apparatus in which in the case of particularly the thick sheet, by blowing a superheated steam to the sheets, the sheets S are dehumidified. Such a technique has been disclosed in Japanese Patent Application Laid-Open No. 2002-333275.

However, in such conventional sheet feeding apparatus and image forming apparatus as mentioned above, when the sheets are separated by blowing the air, particularly, in the low humidity environment, there is a case where portions of the stacked sheets S near the pre-separating nozzle 110 are partially dried by the pre-separating air Ap. If the sheets S are partially dried as mentioned above, a variation occurs in surface resistance values in the sheet surfaces.

Particularly, in the case where the image forming apparatus of an electrophotographic system for transferring a toner image onto the sheet by using static electricity, transfer performance is largely influenced by the surface resistance value of the sheet surface. Therefore, if the sheets S are partially dried and the variation occurs in the surface resistance values in the sheet surfaces as mentioned above, a defective transfer occurs only in the dried portions, so that an image deterioration occurs and image quality deteriorates.

SUMMARY OF THE INVENTION

The invention is made in consideration of such a present situation and the invention provides an image forming apparatus having a sheet feeding apparatus which can feed various types of sheets without causing a deterioration in image quality.

The invention provides an image forming apparatus in which an image is formed by an image forming portion onto a sheet fed from a sheet feeding apparatus, wherein the sheet feeding apparatus comprises: a tray which supports sheets; an attracting and conveying portion which attracts and conveys a top sheet among the sheets supported by the tray; an air blowing portion which blows an air toward the top sheet attracted by the attracting and conveying portion; an air heating mechanism which heats the air blown by the air blowing portion; and a control unit which controls the air heating mechanism based on a moisture content in the sheets.

Further features of the present invention will become apparent from the following description of exemplary embodiments with reference to the attached drawings.

DESCRIPTION OF THE EMBODIMENTS

An exemplary embodiment for embodying the invention will be described in detail hereinbelow with reference to the drawings.

Figure 1:
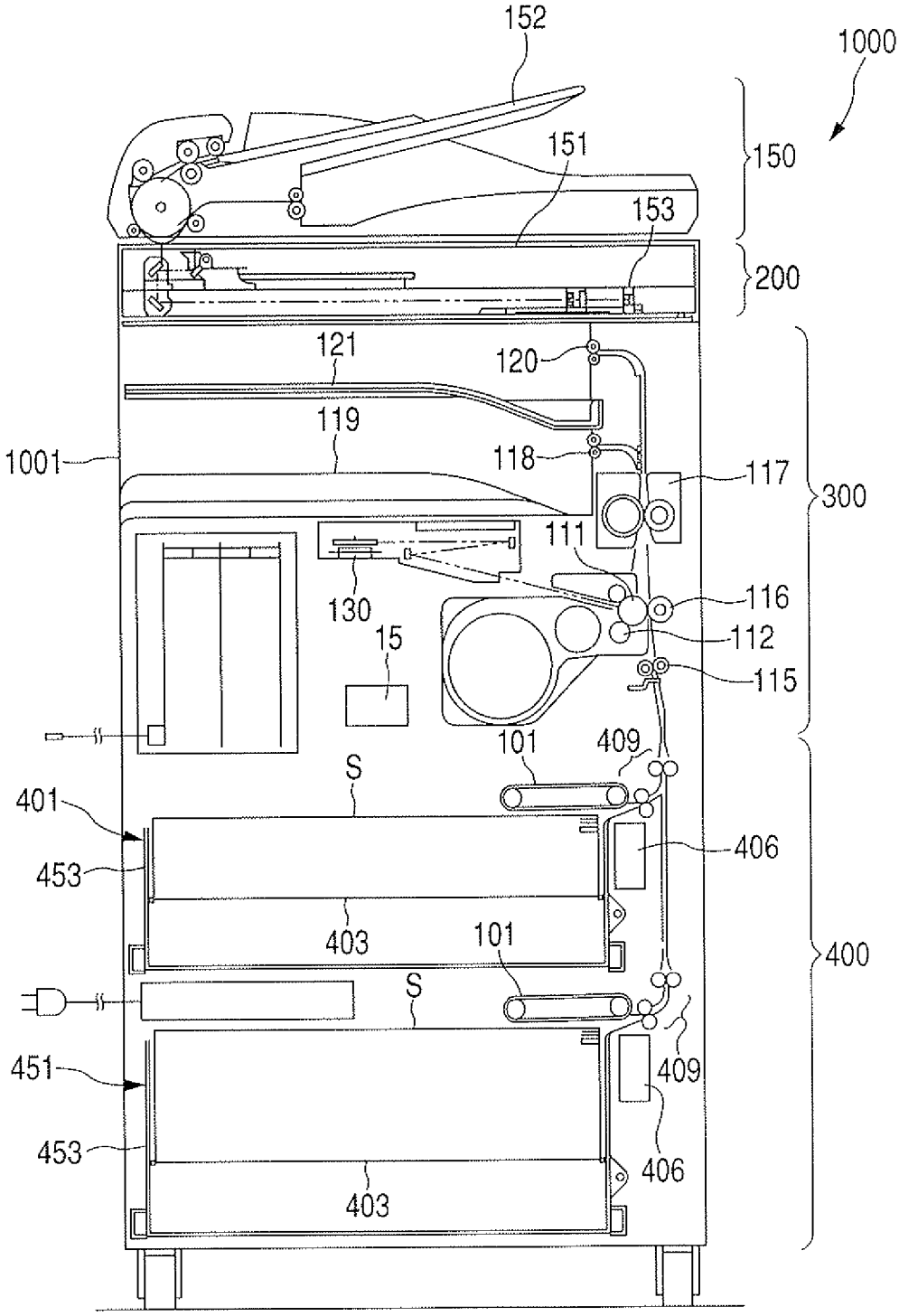
FIG. 1 is a diagram illustrating a schematic construction of a printer as an example of an image forming apparatus having a sheet feeding apparatus according to the first embodiment of the invention.

FIG. 1 is a diagram illustrating a schematic construction of a printer as an example of an image forming apparatus having a sheet feeding apparatus according to the first embodiment of the invention.

In FIG. 1, a printer 1000 and a printer main body 1001 are illustrated. A original document (hereinafter, also referred to as an original) is set on a platen glass 151 as a document setting base plate by an automatic document feeder (hereinbelow, abbreviated to ADF) 150. An image reading unit 200 to read the original is provided in an upper portion of the printer main body 1001. An image forming unit 300 and a sheet feeding apparatus 400 for feeding the sheets S to the image forming unit 300 are provided under the image reading unit 200. The sheet feeding apparatus 400 separates the sheets S by the foregoing air sheet feeding system.

A photosensitive drum 111, a developing unit 112, a laser scanner unit 130, and the like are provided in the image forming unit 300. The sheet feeding apparatus 400 has: first and second paper decks 401 and 451 having a common sheet feeding mechanism; and the attracting and conveying belt 101 for feeding the sheets enclosed in the first and second paper decks 401 and 451.

Further, the sheet feeding apparatus 400 has an air blowing unit 406 for blowing the air from the front edge side of the sheet bundle. The air blowing unit 406 is provided on the side of the sheet feeding direction of the sheet bundle stacked on a tray 403 which has been provided for each of the first and second paper decks 401 and 451 and which will be described hereinafter. The first paper deck 401 can enclose 1500 sheets S. The second paper deck 451 can enclose 2000 sheets S.

The image forming operation of the printer 1000 with such a construction will now be described.

When a start button (not shown) is pressed, the ADF 150 feeds the originals set on a document tray 152 so as to face upward one by one to the left in order from the top page. The ADF 150 conveys the originals through a curved path from the left to the right through a flow-reading position on the platen glass 151. When the original passes through the flow-reading position on the platen glass 151 from the left to the right in this manner, the image reading unit 200 reads an image of the original.

The image read by the image reading unit 200 in this manner is converted into image data by an image sensor 153 and transmitted to the laser scanner unit 130 of the image forming unit 300.

Subsequently, in the image forming unit 300, when the image data is transmitted from the image reading unit 200 to the laser scanner unit 130, a laser beam based on the image data is irradiated from the laser scanner unit 130 onto the photosensitive drum 111. At this time, the photosensitive drum 111 has previously been charged. By irradiating the light onto the drum surface, an electrostatic latent image is formed thereon. Subsequently, by developing the electrostatic latent image by the developing unit 112, a toner image is formed on the photosensitive drum 111.

When a sheet feeding signal is output from the control unit (not shown) to the sheet feeding apparatus 400, the sheets S enclosed in one of the first and second paper decks 401 and 451 are attracted to the attracting and conveying belt 101 and fed. The sheet fed as mentioned above is conveyed to a registration roller 115 through a sheet conveying unit 409, so that its skew feeding is corrected. After that, the sheet is further sent to a transfer unit constructed by the photosensitive drum 111 and a transfer roller 116 so as to be synchronized with the timing of the toner image on the photosensitive drum 111 by the registration roller 115.

Subsequently, the toner image is transferred onto the sheet sent to the transfer unit and, thereafter, the sheet is conveyed to a fixing unit 117. Further, after that, the sheet is heated and pressed by the fixing unit 117, so that a non-fixed transfer image is permanently fixed onto the sheet. The sheet to which the image has been fixed as mentioned above is ejected from the printer main body 1001 to one of discharge trays 119 and 121 by ejecting rollers 118 and 120.

Figure 2:
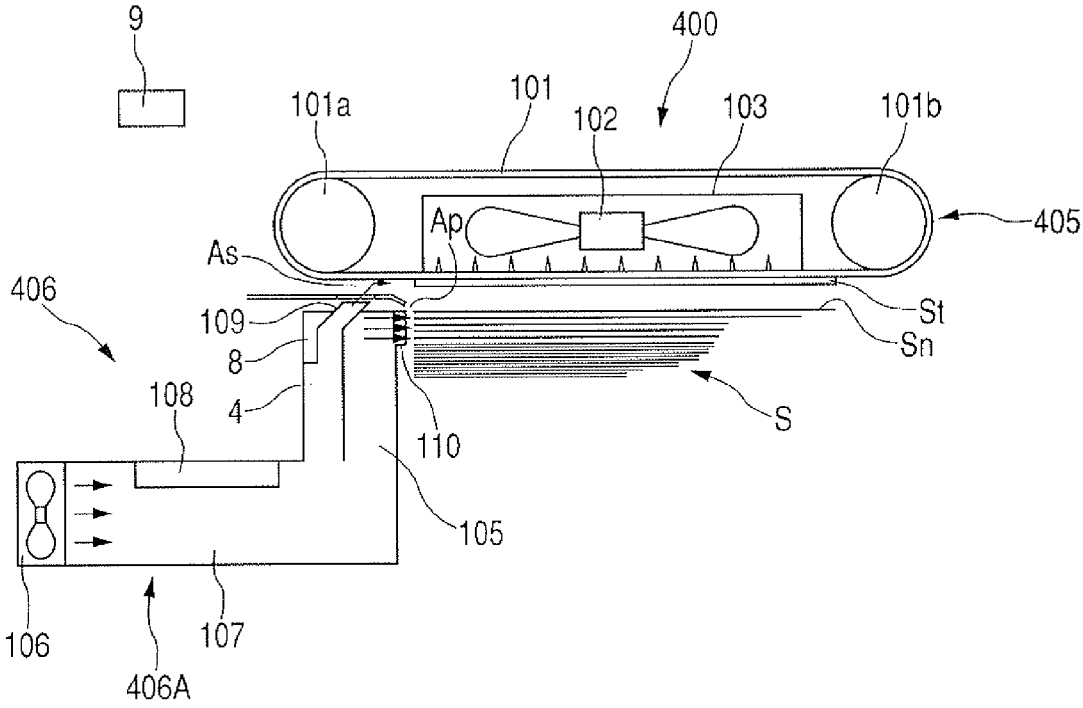
FIG. 2 is a diagram for describing a construction of the sheet feeding apparatus.
Figure 6:
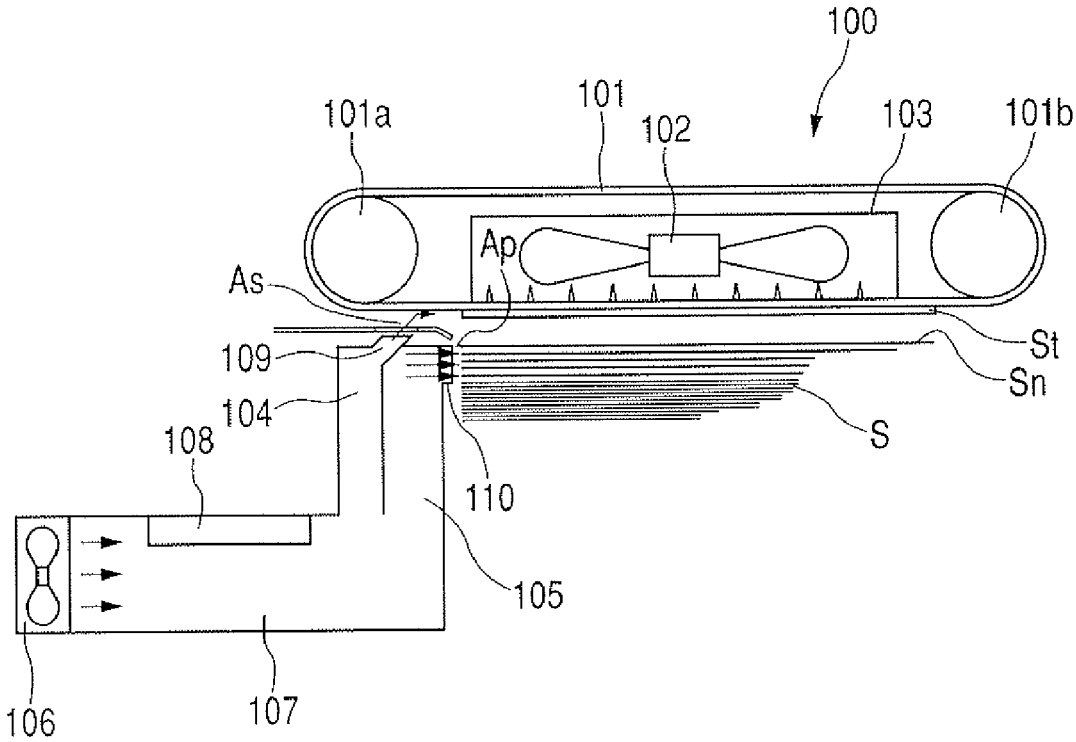
FIG. 6 is a diagram for describing a construction of a conventional sheet feeding apparatus.

FIG. 2 is a diagram for describing a construction of the first paper deck 401. The second paper deck 451 has a construction similar to that of the first paper deck 401. In FIG. 2, the same and similar component elements as those in FIG. 6 are designated by the same reference numerals.

The first paper deck 401 has the tray 403 (refer to FIG. 1) for stacking and holding (supporting) the sheets S. By a lifter elevating mechanism (not shown), the tray 403 is moved to either a descending position adapted to supplement or exchange the sheets or a sheet feeding position adapted to feed the sheets.

The air blowing unit 406 has the pre-separating nozzle 110 as a loosening air blowing unit. The pre-separating nozzle 110 blows the air to the front edge side surfaces of the sheets S stacked on the tray and allows the sheets S to be floated, thereby loosening the sheets S.

The air blowing unit 406 also has the separating nozzle 109 as an air blowing unit. In order to prevent the double feeding, the separating nozzle 109 blows the air to the downstream side in the sheet conveying direction of the attracting and conveying belt 101 and supplies the separating air for separating the next sheet Sn from the top sheet St attracted to the attracting and conveying belt 101. An attracting and conveying unit 405 is constructed by the attracting and conveying belt 101 and the sucking duct 103.

In FIG. 2, a separating air duct 4 guides the air sucked into the duct 107 as a first duct by the fan 106 as an air supplying unit to the separating nozzle 109. The pre-separating air duct 105 guides the air sucked into the duct 107 by the fan 106 to the pre-separating nozzle 110. The duct 107 branches into the separating air duct 4 and the pre-separating air duct 105. An air supplying unit 406A is constructed by the separating air duct 4, duct 107, fan 106, and pre-separating air duct 105. The air heater 108 is provided on the fan 106 side of the duct 107 and can heat the air sucked by the fan 106. A separating air heater 8 is provided on the separating nozzle side of the separating air duct 4 and can heat the air which is blown out from the separating nozzle 109.

An environment sensor 9 detects an atmospheric temperature and an atmospheric humidity in the first paper deck 401. Information showing the temperature and humidity from the environment sensor 9 is input to a control unit 15 as a controller provided at a predetermined position in the printer main body 1001 illustrated in FIG. 1. The control unit 15 predicts a moisture content in the sheets S based on the input temperature and humidity information and controls each heater so that the moisture content in the sheets S is equal to a proper amount based on the predicted amount as will be described hereinafter.

Figure 3:
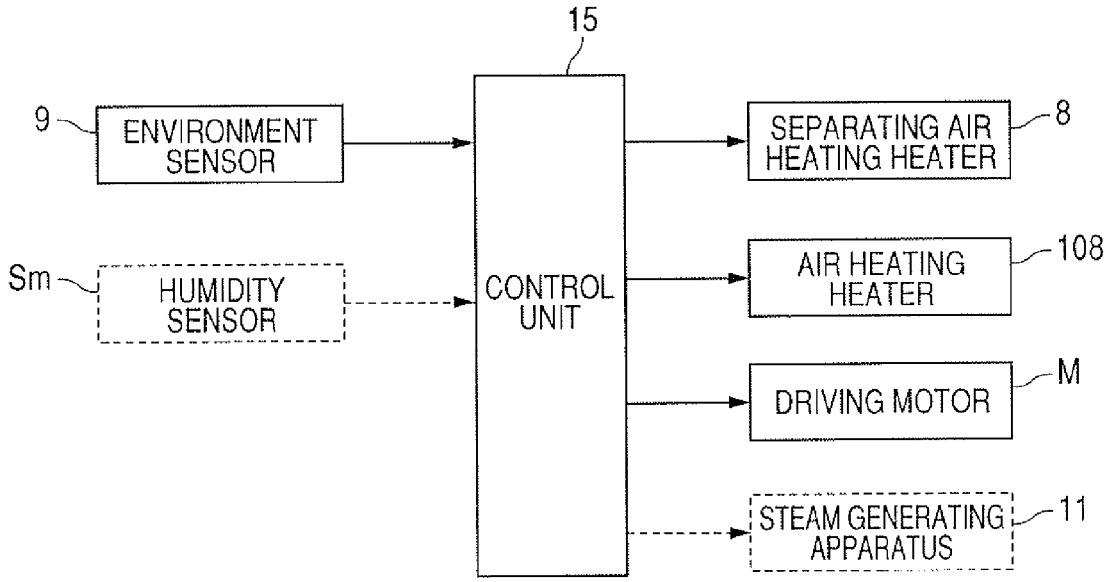
FIG. 3 is a control block diagram of the sheet feeding apparatus.

As shown in FIG. 3, the control unit 15 controls the on/off operations of the separating air heater 8 and the air heater 108 in order to control the heating operation of the separating air heater 8 as an air heating mechanism and the heating operation of the air heater 108 as another air heating mechanism, respectively. The control unit 15 controls the on/off operations of the separating air heater 8 and the air heater 108 based on the moisture content in the sheets S predicted based on the temperature and humidity information from the environment sensor 9.

The control unit 15 controls a rotational speed of a driving motor M for driving the driving roller 101*a* to circle the attracting and conveying belt 101, thereby controlling a speed of the attracting and conveying belt 101. As will be described hereinafter, if a steam generating apparatus 11 is provided for the first paper deck 401, the control unit 15 controls the on/off operation of the steam generating apparatus 11.

The sheet feeding operation in the first paper deck 401 with such a construction will now be described.

When the air is sucked into the duct 107 by the fan 106, the sucked air passes through the air heater 108 controlled based on one of the external (environmental) temperature and the external (environmental) humidity detected by the environment sensor 9. At this time, if the air heater 108 is ON, the air is heated when passing through the air heater 108.

After that, the duct 107 branches into the separating air duct 4 as a second duct and the pre-separating air duct 105 as a third duct. The air is blown out to the outside as one of the separating air As and the pre-separating air Ap from one of the separating nozzle 109 and the pre-separating nozzle 110.

Figure 4:
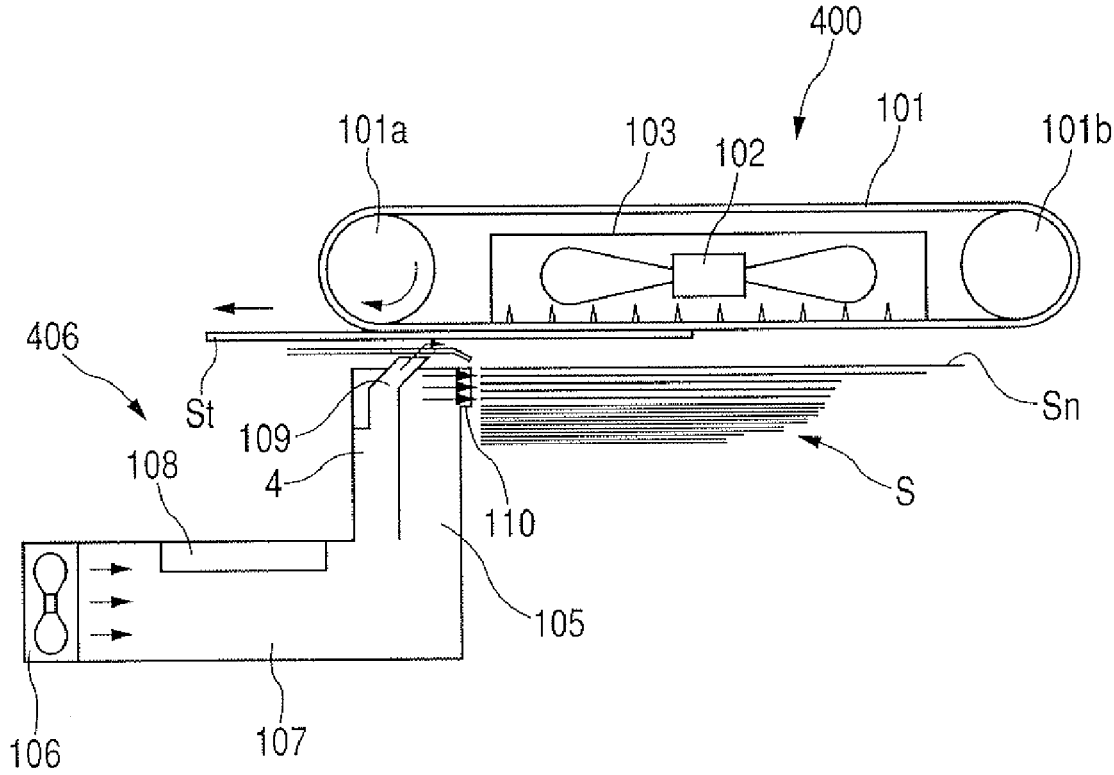
FIG. 4 is a diagram for describing the sheet feeding operation of the sheet feeding apparatus.

Subsequently, when the sucking fan 102 is driven, the top sheet St among a plurality of sheets S in the loosened state as illustrated in FIG. 4 is sucked to the attracting and conveying belt 101. Thereafter, by driving the driving roller 101*a*, the top sheet St is conveyed.

When the sheet is conveyed by the attracting and conveying belt 101 as mentioned above, the separating air As is blown out from the separating nozzle 109 toward the downstream side in the rotating direction of the attracting and conveying belt 101. The next sheet Sn of the top sheet St is separated by the separating air As.

When the separating air As is blown from the separating nozzle 109 as mentioned above, the control unit 15 allows the separating air As to be further heated by the separating air heater 8 based on the external temperature and humidity detected by the environment sensor 9.

The top sheet St is conveyed passes over the separating nozzle 109 and is fed. Therefore, when the separating air heater 8 is turned on, the separated sheet is sent in the state where the heated separating air As has been blown to the lower surface and almost the whole sheet area is heated. Thus, the moisture content of the whole sheet area can be adjusted.

Specifically speaking, since a variation in drying state is liable to occur in the high humidity environment, in the high humidity environment, by turning on the separating air heater 8 and raising the temperature of the separating air As, the whole area of the top sheet St is uniformly dried by the separating air As.

In the embodiment, the condition for turning on the separating air heater 8 and the air heater 108 is determined as follows.

Discrimination value $Jp$=(atmospheric temperature (° C.)−25)+(atmospheric humidity (%)−60)

Discrimination value Jp≧0: air heater (On)

Discrimination value Jp≧20: air heater and separating air heater (On)

The following Table shows the conditions for turning on the separating air heater 8 and the air heater 108 at the atmospheric temperature and the atmospheric humidity. In this Table, an axis of ordinate indicates the atmospheric temperature and an axis of abscissa indicates the atmospheric humidity. In this Table, 1 indicates that only the air heater 108 is turned on, and 2 indicates that the air heater 108 and the separating air heater 8 are turned on.

TABLE 1

| | | | | | | | | | | | |
|---|---|---|---|---|---|---|---|---|---|---|---|
| 40 | — | — | — | — | — | 1 | 1 | 2 | 2 | 2 | 2 |
| 35 | — | — | — | — | — | 1 | 1 | 2 | 2 | 2 | 2 |
| 30 | — | — | — | — | — | — | 1 | 1 | 2 | 2 | 2 |
| 25 | — | — | — | — | — | — | 1 | 1 | 2 | 2 | 2 |
| 20 | — | — | — | — | — | — | — | 1 | 1 | 2 | 2 |
| 15 | — | — | — | — | — | — | — | 1 | 1 | 2 | 2 |
| 10 | — | — | — | — | — | — | — | — | 1 | 1 | 2 |
| | 0 | 10 | 20 | 30 | 40 | 50 | 60 | 70 | 80 | 90 | 100 |

By uniformly drying the whole sheet area of the top sheet St by the separating air As as mentioned above, the drying variation can be reduced. Since calculating methods of the discrimination value Jp to make control as mentioned above differ depending on the construction of the apparatus, the invention is not limited to the numerical values shown in the embodiment.

As described above, by controlling the heating operation of only the air heater 108 or the heating operations of the separating air heater 8 and the air heater 108 based on the temperature and humidity information from the environment sensor 9, the sheets S can be uniformly dried.

That is, by heating not only the pre-separating air Ap to attract the top sheet St but also the separating air As based on the moisture content which is supposed to be contained in the sheets S, the moisture content of the sheets S can be optimally adjusted according to the environment. Thus, the sheet can be stably fed. A drying variation in the sheet surface can be also prevented. Consequently, the occurrence of image defects can be prevented while suppressing a transfer variation. Thus, various types of sheets can be fed without causing a deterioration of the image quality.

The second embodiment of the invention will now be described.

Figure 5:
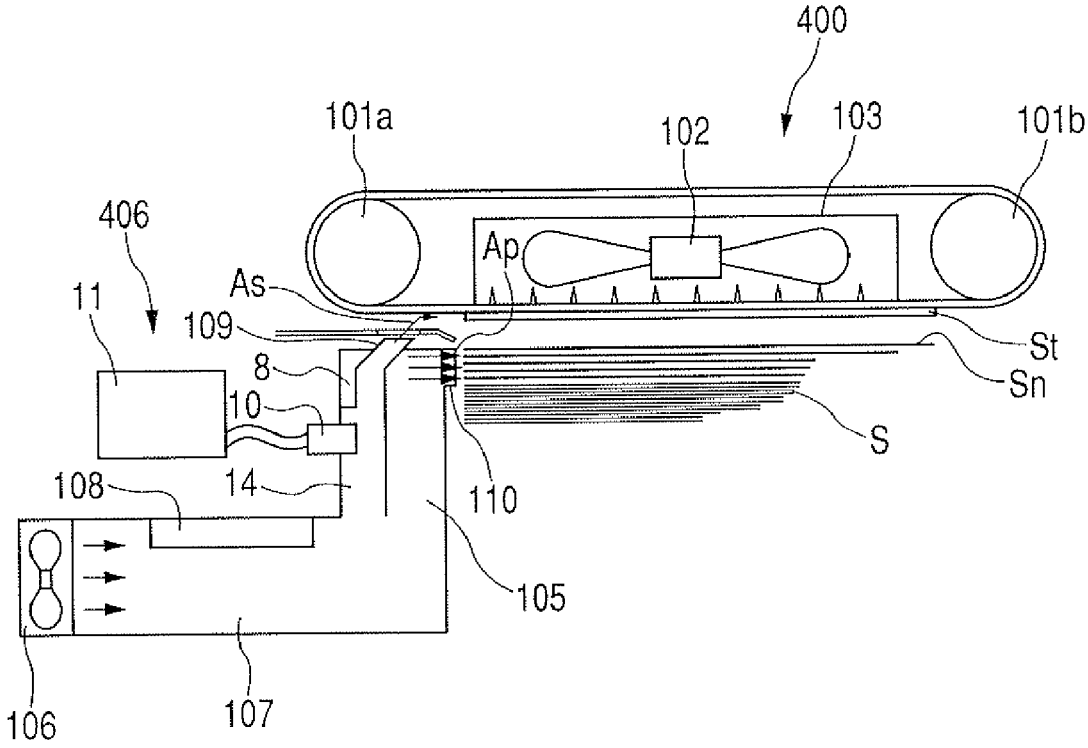
FIG. 5 is a diagram for describing a construction of a sheet feeding apparatus according to the second embodiment of the invention.

FIG. 5 is a diagram for describing a construction of a sheet feeding apparatus according to the second embodiment of the invention. In FIG. 5, the same and similar component elements as those in FIG. 2 are designated by the same reference numerals.

In FIG. 5, a separating air duct 14, a steam nozzle 10, and the steam generating apparatus 11 as a steam generating unit are provided. The steam generated by the steam generating apparatus 11 is introduced into the separating air duct 14 by the steam nozzle 10. The steam introduced into the separating air duct 14 as mentioned above is blown out from the separating nozzle 109 toward the sheet St which passes over the separating nozzle 109.

By blowing out the steam toward the sheet St in this manner, the drying variation can be prevented and the moisture content of the sheet St can be adjusted. However, if the pre-separating air Ap is humidified, since the sheets are mutually attracted, only the separating air As is humidified and the sheet St which is fed is humidified.

In the embodiment, in a manner similar to the air heater 108 and the separating air heater 8, the steam generating apparatus 11 is controlled by the control unit 15 as illustrated in FIG. 3 mentioned above based on the external temperature and humidity detected by the environment sensor 9.

In the embodiment, the condition for turning on the separating air heater 8, the air heater 108, and the steam generating apparatus 11 are determined as follows.

Discrimination value $Jp$=(atmospheric temperature (° C.)−25)+(atmospheric humidity (%)−60)

Discrimination value Jp≧0: air heater (On)

Discrimination value Jp≧20: air heater and separating air heater (On)

Discrimination value Jp<−40: steam generating apparatus (On)

As mentioned above, in the embodiment, the moisture content of the sheet St is adjusted by using the steam generating apparatus 11 in addition to the separating air heater 8 and the air heater 108. Since the calculating methods of the discrimination value Jp to make control as mentioned above differ depending on the construction of the apparatus, the invention is not limited to the numerical values shown in the embodiment.

In the case where, particularly, a thick sheet is used and the drying variation of the sheet St cannot be sufficiently eliminated by the separating air heater 8, it is desirable to turn on the steam generating apparatus 11 and the separating air heater 8 and set the temperature of the separating air As to 170° C. or higher. The steam of 170° C. or higher is what is called a superheated steam and since dehumidification performance is higher than that of the ordinary air as disclosed in Japanese Patent Application Laid-Open No. 2002-333275, the drying variation of the sheet St can be easily eliminated.

Further, it is also possible to construct the apparatus in such a manner that by controlling the rotational speed of the driving motor M (refer to FIG. 3) based on the external temperature and humidity detected by the environment sensor 9, the speed of the driving roller 101*a* is adjusted and the sheet conveying speed (rotational speed) of the attracting and conveying belt 101 is changed.

By changing the sheet conveying speed as mentioned above, a time (total volume) which is necessary for the separating air As to be blown to the top sheet St can be changed. The dehumidifying/humidifying effects by the separating air As can be adjusted.

For example, in the high temperature and high humidity environment, by rotating the driving roller 101*a* at a speed lower than that in the ordinary state, the conveying speed of the top sheet St is reduced. Thus, even if the moisture content of the sheet on the tray 403 is large, a time during which the top sheet St is buffeted with the separating air As becomes long. Consequently, the sheet is dried by the separating air As for a longer time, and dehumidification performance of the whole sheet area can be improved.

Although the temperature of the air has been adjusted by controlling the on/off operations of the separating air heater 8 and the air heater 108 in each of the foregoing embodiments, it is also possible to properly heat the air by adjusting the heating temperature by using the heaters whose temperatures can be adjusted. In such a case, the optimum air heating temperature according to the moisture content of the sheet which is presumed by the external temperature and humidity is preliminarily obtained by experiments or the like, and the heating temperature of each heater is adjusted based on the detection results of the environment sensor 9.

Although the moisture content of the sheets S has been presumed based on the external temperature and humidity detected by the environment sensor 9 and the separating air heater 8 and the air heater 108 have been controlled based on the presumed moisture content in the embodiments, the invention is not limited to such a construction. For example, the moisture content of the sheet stacked on the tray can be also directly detected by a moisture content detecting sensor Sm (shown in FIG. 3). The moisture content detecting sensor detects the moisture content of the sheet by detecting one of a change in electrostatic capacitance of the sheet and a change in weight of the sheet from a standard state.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-140887, filed May 19, 2006, which is hereby incorporated by reference herein in its entirety.

What is claimed is:

1. An image forming apparatus in which an image is formed by an image forming unit onto a sheet fed from a sheet feeding apparatus, wherein the sheet feeding apparatus comprises:

a tray which supports sheets;

an attracting and conveying unit which attracts and conveys a top sheet among the sheets supported by the tray;

a loosening air blowing portion which blows the air to edge portions of the sheets supported by the tray, thereby allowing the sheets to be floated;

a separating air blowing portion which blows air toward an upper side of the sheets on the tray to separate the top sheet among the sheets which are floated by the loosening air blowing portion;

an air supplying portion which supplies the air to the separating air blowing portion;

a first duct through which the air supplied from the air supplying portion passes;

a second duct which branches from the first duct and guides the air supplied by the air supplying portion to the separating air blowing portion;

a third duct which guides the air to the loosening air blowing portion;

an air heating mechanism which is provided in the second duct and heats the air blown by the separating air blowing portion;

another air heating mechanism which is provided in the first duct and heats the air blown to the sheets from the separating air blowing portion and the loosening air blowing portion; and a control unit which controls the air heating mechanism based on a moisture content in the sheets, wherein the air from the separating air blowing portion is blown against a lower surface of the sheet conveyed by the attracting and conveying unit.

2. An apparatus according to claim 1, further comprising an environment sensor which detects an environment in an main body of the sheet feeding apparatus, wherein the control unit predicts the moisture content in the sheets on the tray based on a detection result of the environment sensor and controls the air heating mechanism based on the predicted moisture content.

3. An apparatus according to claim 1, further comprising a moisture content detecting sensor which detects the moisture content in the sheets on the tray, wherein the control unit controls the air heating mechanism based on a detection result of the moisture content in the sheet by the moisture content detecting sensor.

4. An apparatus according to claim 1, further comprising a steam generating portion which generates steam to humidify the air that is blown out from the separating air blowing portion, wherein the control unit drives the steam generating portion based on the moisture content in the sheets supported by the tray.

5. An apparatus according to claim 1, wherein the control unit controls a sheet conveying speed of the attracting and conveying unit based on the moisture content in the sheets supported by the tray so as to be lower as the moisture content in the sheet is larger.

* * * * *